US007972165B1

(12) United States Patent
Lifson

(10) Patent No.: US 7,972,165 B1
(45) Date of Patent: Jul. 5, 2011

(54) APPARATUS FOR PROVIDING A SECURE CONNECTION BETWEEN DIFFERENT DEVICES

(76) Inventor: Charles Lifson, Rome, NY (US)

( * ) Notice: Subject to any disclaimer, the term of this patent is extended or adjusted under 35 U.S.C. 154(b) by 0 days.

(21) Appl. No.: 12/710,069

(22) Filed: Feb. 22, 2010

(51) Int. Cl.
*H01R 13/62* (2006.01)

(52) U.S. Cl. ..... 439/369; 439/373

(58) Field of Classification Search ..... 439/369–373; 604/174

See application file for complete search history.

(56) References Cited

U.S. PATENT DOCUMENTS

| | | | | | |
|---|---|---|---|---|---|
| 2,720,633 | A | | 10/1955 | Westberg | |
| 2,753,536 | A | | 7/1956 | Tjader | |
| 3,228,640 | A | * | 1/1966 | Wolsh | 24/339 |
| 3,300,168 | A | * | 1/1967 | Gaudino | 248/227.2 |
| 3,475,716 | A | * | 10/1969 | Laig | 439/369 |
| 3,907,239 | A | * | 9/1975 | Ehrlich | 248/229.26 |
| 3,983,602 | A | * | 10/1976 | Barry | 24/11 R |
| 4,183,603 | A | | 1/1980 | Donarummo | |
| 4,204,738 | A | | 5/1980 | Tillotson | |
| 4,617,775 | A | * | 10/1986 | Padrun | 52/684 |
| 4,664,463 | A | | 5/1987 | Carmo | |
| 4,773,874 | A | | 9/1988 | Kopeski, Jr. | |
| 4,900,184 | A | * | 2/1990 | Cleveland | 403/397 |
| 5,255,866 | A | | 10/1993 | Campolo | |
| 5,334,042 | A | | 8/1994 | Chevalier | |
| 6,394,285 | B1 | * | 5/2002 | Arthurs et al. | 211/41.9 |
| 6,477,744 | B1 | * | 11/2002 | Miles | 24/3.12 |
| 6,997,734 | B1 | * | 2/2006 | McQuirter | 439/369 |
| 7,186,130 | B1 | | 3/2007 | Miller | |

* cited by examiner

*Primary Examiner* — Thanh-Tam T Le
(74) *Attorney, Agent, or Firm* — Gilman Pergament LLP

(57) ABSTRACT

An apparatus for holding at least two devices together is provided with a first securing member, a second securing member, and a connecting member extending between the first and second securing members. The first securing member may be an elongate member having first and second ends such that the elongate member has a length between said first and second ends sufficient to wrap around one of the at least two devices, and the first end of the first securing member having securing means that operates to connect the first end to the second end. The second securing member may receive at least one other of the at least two devices, and may have at least two substantially linearly aligned receptacles. Each receptacle may receive the at least one other of the at least two devices. The two devices may be one or more cords, extension cords, and electrical plugs.

19 Claims, 6 Drawing Sheets

APPARATUS FOR PROVIDING A SECURE CONNECTION BETWEEN DIFFERENT DEVICES

FIELD OF THE INVENTION

The present invention is directed to an apparatus having first and second securing members, and a connecting member extending therebetween, for holding and gripping at least two devices together, such as, but not limited to, plugs, cords, extension cords, power strips, or the like.

BACKGROUND OF THE INVENTION

The popularity of using electrical and/or electronic devices, such as televisions, toasters, media players, phones, computers, coffee machines, etc., has increased over time. As the popularity of such electrical and/or electronic devices has grown and increases to grow, challenges related to the use of such devices have emerged.

Electrical devices typically are connected to, or are connectable to, some type of power cord and/or electrical plug to function properly, e.g., for recharging a battery of the device, to provide a constant supply of power, etc. Power cord(s) and/or electrical plug(s) of an associated electrical device usually connect to other power cords, plugs, power strips, or the like to provide electrical energy to the associated device. A power cord may include a plug that mates with a corresponding plug and/or electrical socket of another cord, extension cord, power strip, etc. to provide the electrical energy needed to power any associated device.

Devices that typically employ a plug, a power cord, or a power cord with an associated plug, have no way of securing and maintaining the connection between the first cord and/or plug and a second corresponding electrical plug and/or cord. As such, when environmental forces act upon one or more traditional devices, the cord and plug of the one or more traditional devices are susceptible to disconnection from the second corresponding plug, cord, power strip, etc. For example, when a user of a television moves a piece of furniture, on which the television rests, away from an electrical socket (e.g., to clean behind the furniture, redesign the layout of the room, etc.), the cord and/or plug of the television may become disconnected from a power strip connected to the socket, an extension cord connected to the cord of the television, etc. Typically a cord has a plug which attaches to another plug of another cord.

Forces acting on the plugs/cords can not only disconnect the plugs/cords, but can also damage or destroy the structural and electrical connection between the plugs and their respective cords. For example, if a user pulls on a cord with a predetermined force, the user may accidentally break the cord from the plug, thereby rendering the cord inoperable without repairing the connection between the cord and its plug. Alternatively or additionally, the damaged cord and/or plug may leave electrical wires exposed, which could harm the user or another near the device.

One of the ways users have previously attempted to prevent such disconnection was to tie a knot at the end of a cable (e.g., near the plug of the cable) with another cable and plug. For example, contractors may employ various types of cables running through a building, and may tie a knot with such cables together to avoid disconnection due to various workplace conditions (e.g., a worker kicks the cables, construction material pushes/knocks into the cables, cables extend vertically to different floors/ceilings, etc.). However, such knots damage the device, e.g., cables, cords, plugs, etc. because the device bends in a way that is unintended for use of the device when manufactured. Indeed, the knotting of the device leaves the device susceptible to unintended forces acting thereon, which may lead to the aforementioned risks of exposed wires and electrical shock. As such, there is a need in the art to prevent disconnection, inoperability, and other harmful aspects of electrical devices.

Many other times, to prevent the aforementioned disconnection, inoperability, or other harmful aspects of electrical devices, users may employ, or makers of the devices may install, longer cords to compensate and account for any forces that may pull on the cords, plugs, etc. Even though additional cord length may reduce some problems associated with electrical cords/plugs, this solution does not prevent all occurrences. Additionally, merely increasing cord length can result in inefficiencies, such as increased cost, inefficient use of space, or the like, during manufacture, installation, and/or operation. This can also result in discomfort for the user (e.g., due to cables under a computer desk occupying foot space), or can simply result in an unappealing aesthetic in a living space (e.g., too many cables/cords sticking out from behind the television stand, too much space occupied, cables/cords of different sizes, etc.) Providing ergonomic characteristics, such as increased space availability, fewer movements for moving, connecting, disconnecting cords/plugs, etc., are important for effective and comfortable user interaction.

Thus, it would therefore be desirable to provide an apparatus that preserves the connection between an electrical cord, plug, power strip, etc. There is also a need in the art to preserve the connection such that the cord, plug, power strip, etc. does not become inoperable or an electric shock risk is not created (e.g., due to an exposed wire resulting from damage to the cord, plug, etc.).

SUMMARY OF THE INVENTION

In accordance with one or more embodiments of the present invention, an apparatus for securing a connection between two devices is provided with first and second members for securing at least one respective device, such as a power cord, plug, cable, power strip, coaxial cable, hose(s), tube(s), etc., and a member for connecting the first securing member to the second securing member. The apparatus is used to preserve the connection between at least two devices by gripping and securing the devices, such as, but not limited to, an electrical cord, plug, power strip, etc. Such preservation avoids inoperability of, or an electric shock risk (e.g., due to an exposed wire(s), broken plug-cord connection, etc.) of, the at least two devices. The present invention of the instant application allows for cost reduction associated with employing long wires, cables, plugs, cords, etc., and provides for efficient use of space (e.g., because less overall cord, wire, plug length is needed for making the connection).

In accordance with one or more embodiments of the present invention, an apparatus for holding at least two devices together, the apparatus includes: a first securing member including an elongate member having first and second ends, the elongate member having a length between said first and second ends sufficient to wrap around one of the at least two devices, and the first end of the first securing member having securing means that operates to connect the first end to the second end; a second securing member operating to receive at least one other of the at least two devices, the second securing member having at least two substantially linearly aligned receptacles, each receptacle operating to receive the at least one other of the at least two devices; and a connecting member coupled to, and extending from, said first securing member to said second securing member.

The second securing member may include a base having first and second ends; and a pair of first and second fingers, each having first and second ends, the first and second fingers being connected to the base at first ends thereof and extending away from the base, wherein the at least two substantially linearly aligned receptacles are located therebetween. The base and the pair of fingers may be integral.

The first and second fingers may be opposed to, spaced apart from, and springingly biased toward, one another. An edge of each finger facing the other finger may be an inner edge. The inner edges of the first and second fingers may include at least two adjacent arch portions that define corresponding first and second portions of the at least two substantially linearly aligned receptacles. A second end of each of the fingers may be movable against a force of the spring bias of each of the fingers. Each of the fingers may have a respective cantilevered attachment to the base, thereby forming a spring loaded grip that operates to hold the at least one other of the at least two devices therebetween.

The base may include two levers, each lever extending from the first and the second ends of the base away from each other, such that the fingers operate to be opened and/or moved away from each other when the two levers are both pulled away from the fingers; and the fingers may operate to: (i) substantially return to their original configuration and/or a rest position when the two levers are released and/or substantially return to their original configuration and/or rest positions and when the at least one other of the at least two devices fits within, and/or is removed from, one of the at least two substantially linearly aligned receptacles; and (ii) substantially grip, and clamp, the at least one other of the at least two devices when the at least one other of the at least two devices has a diameter that is substantially the same or larger than a diameter of the one of the at least two substantially linearly aligned receptacles.

The first and second portions of the at least two receptacles may be sized and shaped to receive, and to grip, at least one portion of the at least one other of the at least two devices between at least one of: the first and the second portions of a first of the at least two substantially linearly aligned receptacles; and the first and the second portions of a second of the at least two substantially linearly aligned receptacles. A diameter of the at least two substantially linearly aligned receptacles may be at least: about 2 mm-about 12 mm; about 4 mm-about 10 mm; and about 7.5 mm-about 9 mm.

The inner edge of each finger may include at least three adjacent arch portions that define corresponding first and second portions of at least three substantially linearly aligned receptacles. The adjacent arch portions may be concave. The first and the second of the at least two substantially linearly aligned receptacles may be at least one of: co-planar; spaced apart by a predetermined distance; and include a notch separating each pair of the at least two substantially linearly aligned receptacles. The first and second portions of the at least three receptacles may be sized and shaped to receive, and to grip, at least one portion of the at least one other of the at least two devices between at least one of: the first and the second portions of a first of the at least two substantially linearly aligned receptacles; the first and the second portions of a second of the at least two substantially linearly aligned receptacles; and the first and the second portions of a third of the at least two substantially linearly aligned receptacles. The first, the second, and the third of the at least two substantially linearly aligned receptacles may be at least one of: co-planar; spaced apart by a predetermined distance; and include a notch separating each pair of the at least two substantially linearly aligned receptacles. The at least one portion of the at least one other of the at least two devices may have substantially the same or a larger diameter than a diameter of the receptacle, when in a rest position, in which it is held.

The securing means may operate to releasably close the first securing member around an outer surface of the one of the at least two devices.

The connecting member may include at least one of: an adjustment element that operates to increase and/or decrease a length thereof such that the first securing member and the second securing member can be located at a predetermined position on the one and the at least one other of the at least two devices, respectively; and stretchable, flexible, and/or elastic material.

The apparatus may be at least one of: transparent, semi-transparent and opaque. The first securing member, the second securing member, and/or the connecting member may include at least one of: clear plastic, polyurethane polymer, textile material, polymer, thermoplastic polyurethane polymer, cloth fabric, vinyl, leather, suede, synthetics, and substantially resilient material.

The present invention of the instant application allows for the first time the secure and consistent attachment of one device, such as, but not limited to, a plug, cord, extension cord, etc. to another device, such as, but not limited to, a plug, cord, extension cord, etc.

BRIEF DESCRIPTION OF THE DRAWINGS

For the purposes of illustrating the various aspects of the invention, wherein like numerals indicate like elements, there are shown in the drawings simplified forms that may be employed, it being understood, however, that the invention is not limited by or to the precise arrangements and instrumentalities shown, but rather only by the claims. To assist those of ordinary skill in the relevant art in making and using the subject matter hereof, reference is made to the appended drawings and figures, wherein:

DETAILED DESCRIPTION OF THE PRESENT INVENTION

An apparatus including convenient securing members and connecting member extending therebetween is disclosed herein for securing a connection between two devices. Devices that may be placed within the apparatus by a user include, but are not limited to, an electrical cord, plug, power strip, etc. The apparatus may be employed in automobiles, living environments such as homes and apartments, work environments such as offices, public spaces such as local parks, or the like. In particular, the present invention relates to an apparatus that preserves a connection between one or more electrical cords, plugs, power strips, etc.

Figure 1:
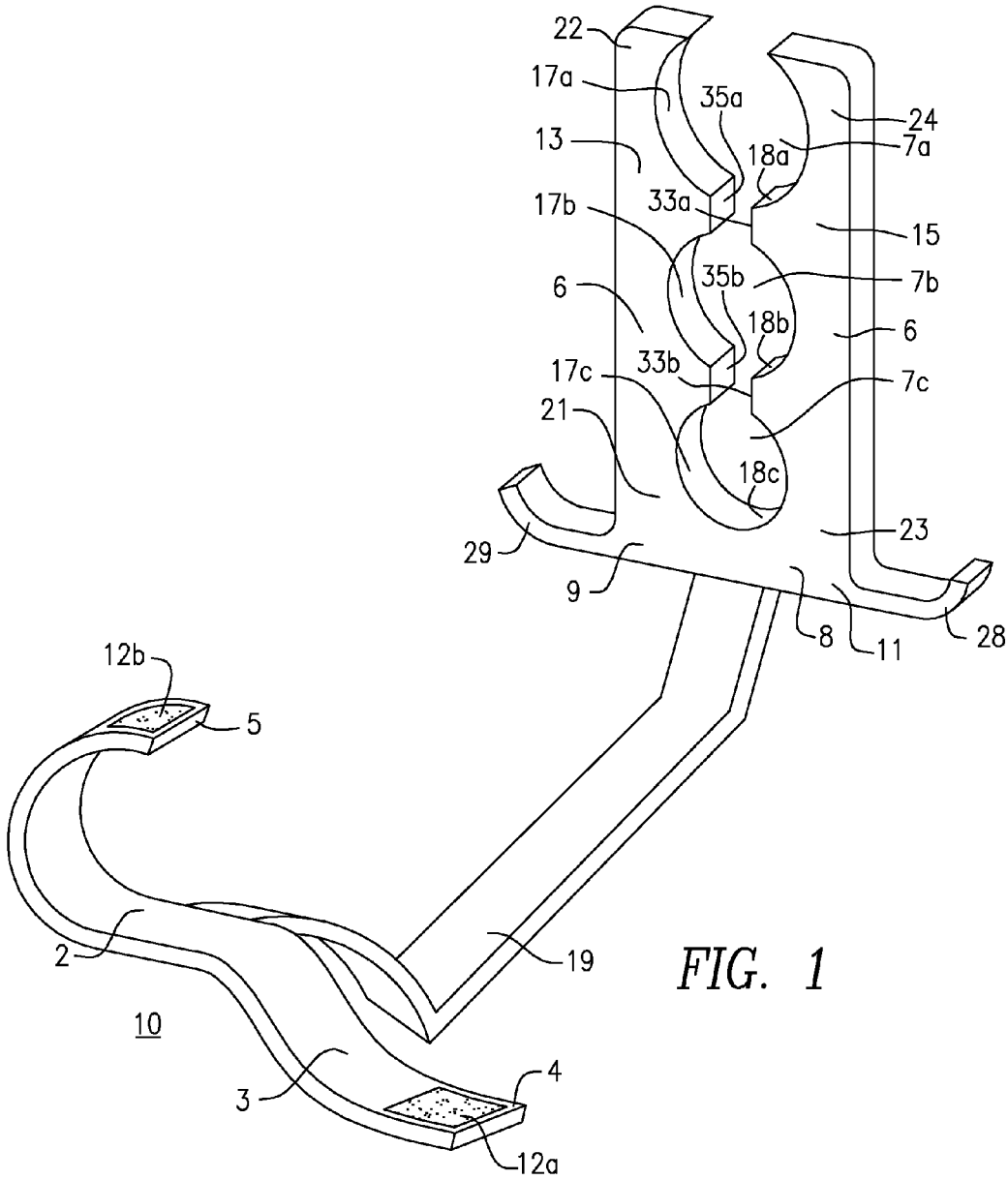
FIG. 1 is a perspective view of an apparatus for providing a secure connection between two devices in accordance with at least one embodiment of the present invention.
Figure 2:
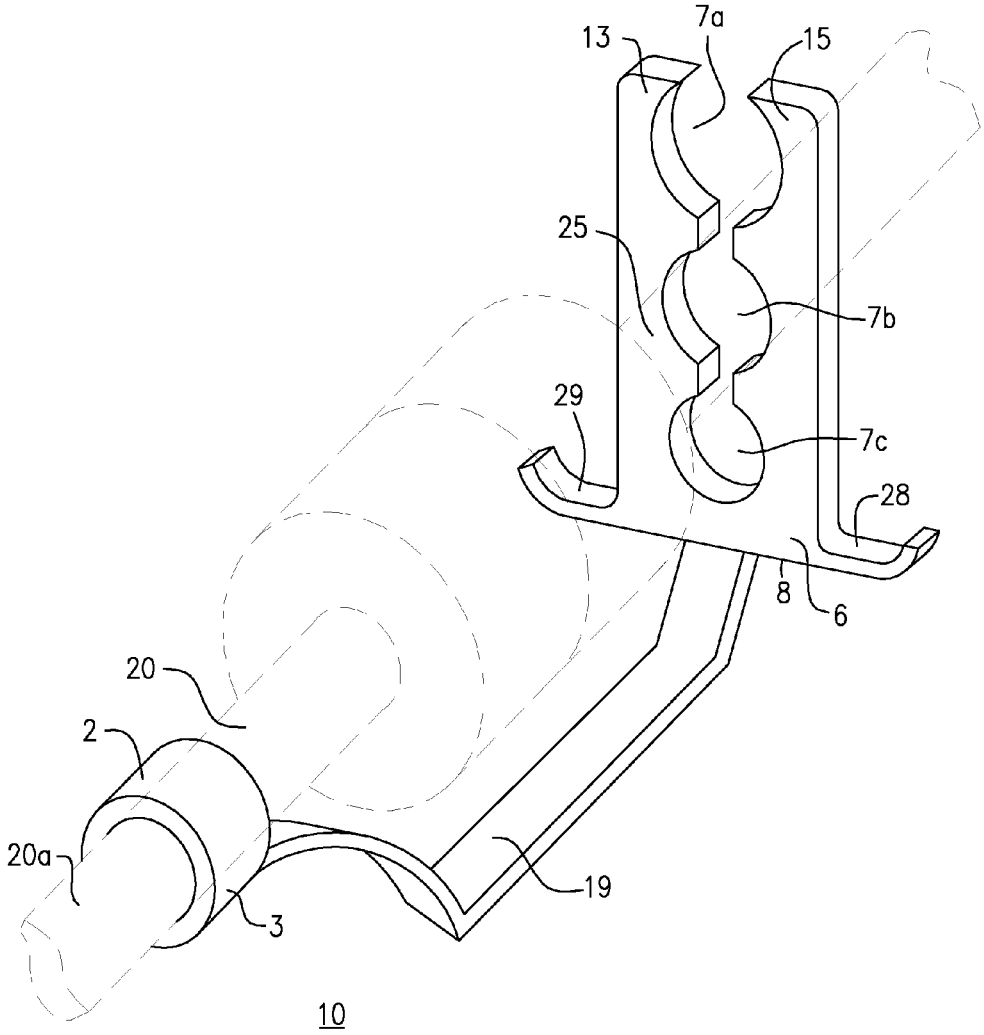
FIG. 2 is a perspective view of the apparatus of FIG. 1 after securing two devices (indicated with dashed lines) in the first and second securing members in accordance with at least one embodiment of the present invention.
Figure 3A:
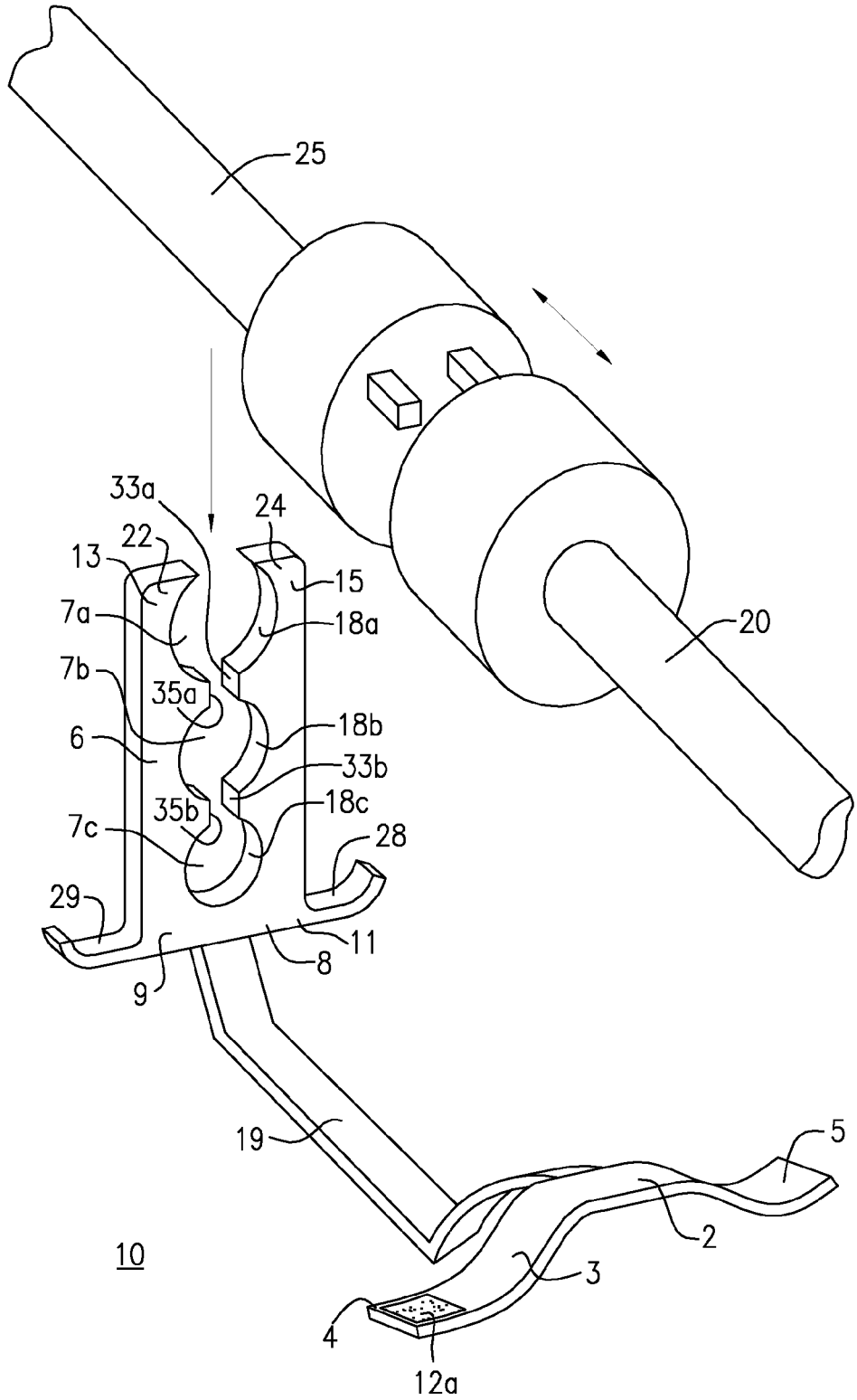
FIGS. 3A-3B are perspective views illustrating two devices being connected and secured in the apparatus of FIG. 1 in accordance with at least one embodiment of the present invention.
Figure 3B:
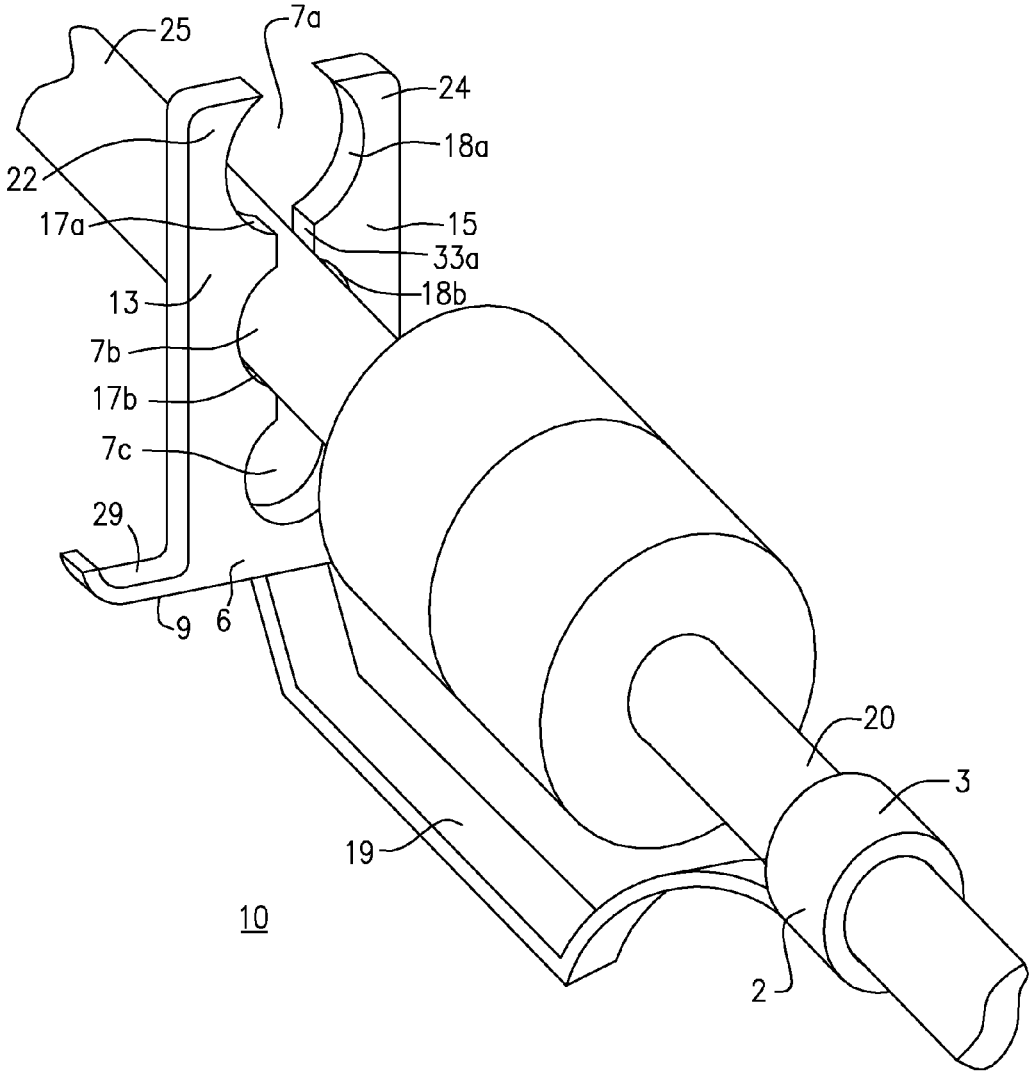

Turning now to the details of the drawings, FIG. 1 illustrates an apparatus 10 including a first securing member 2 comprising an elongate member 3 having first and second ends 4 and 5; a second securing member 6 having at least two substantially linearly aligned receptacles 7*a*, 7*b*, and 7*c*, each receptacle operating to receive the at least one other of the at least two devices; and a connecting member 19 coupled to, and extending from, the first securing member 2 to the second securing member 6. As best seen in FIGS. 2 and 3B, the elongate member 3 of the first securing member 2 operates to secure a device 20 therein, and the second securing member 6 operates to receive and secure at least one other device 25 of the at least two devices 20 and 25 therein. Preferably, the elongate member has a length between the first end 4 and the second end 5 sufficient to wrap around one device 20 of at least two devices 20 and 25. Each receptacle 7*a*, 7*b*, 7*c* of the second securing member 6 may be used to receive and secure the at least one other device 25 of the at least two devices 20 and 25. The apparatus 10 may be integrated with one of the at least two devices 20 and 25. Preferably, the apparatus 10 is releasably connected to the one or more devices 20 and 25 (as illustrated in FIGS. 2-5; shown in dashed lines in FIG. 2).

The at least two devices 20 and 25 include, but are not limited to, an electrical cord, plug, power strip, etc. At least one portion of the at least one other device 25 of the at least two devices 20 and 25 may have substantially the same or a larger diameter than a diameter of the receptacle 7*a*, 7*b*, 7*c*, when in a rest position, in which the device 25 is held. However, those skilled in the art will appreciate that the device 25 may be gripped or secured in a receptacle 7*a*, 7*b*, 7*c* even when the diameter of the at least one portion of the device 25 is smaller than the diameter of the receptacle 7*a*, 7*b*, 7*c* in which it is located (e.g., when an opening of a receptacle 7*a*, 7*b*, 7*c* is smaller than a diameter or thickness/width of the device 25).

As best seen in FIG. 1, at least the first end 4 of the elongate member 3 of the first securing member 2 includes a securing means 12*a* for connecting the first end 4 to the second end 5. In at least one embodiment, the first and second ends 4 and 5 of the elongate member 3 include respective securing means 12*a* and 12*b* disposed thereon. Preferably, the securing means 12*a* of the first end 4 operates to connect the first end 4 to the other securing means 12*b* disposed on the second end 5. The securing means 12*a*, 12*b* may operate to releasably close the first securing member 2 around an outer surface 20*a* of the one device 20 of the at least two devices 20 and 25. The securing means 12*a* and 12*b* may include, but is not limited to, a latch-catch arrangement, a button-groove configuration, an adjustable band (e.g., a cinch buckle, an adjustor, or the like for sliding a device therethrough and reducing the size of the band to secure the device), a clasp, a closure buckle, a clip, a fastener, a Velcro arrangement, etc. For example, a user of the apparatus 10 may wrap the elongate member 3 around a first device 20 and secure the device 20 in the elongate member 3 by releasably connecting a Velcro piece 12*a* on the first end 4 to another Velcro piece 12*b* on the second end 5.

The second securing member 6 may further include a base 8 and two fingers 13 and 15 connected to, and extending away from, the base 8. The base 8 and/or the first and second fingers 13 and 15 of the second securing member 6 may act to create a "gripping" or "clamping" feature for securing the other device 25. Preferably, the fingers 13 and 15 each have a respective cantilevered attachment to the base 8, thereby forming a spring loaded grip that operates to hold the at least one other device 25 of the at least two devices 20 and 25 therebetween. The base 8 of the second securing member 6 may include first and second ends 9 and 11, and the first and second fingers 13 and 15 of the second securing member 6 may each include a first 21, 23 end and a second end 22, 24, respectively. The first ends 21 and 23 of the first and second fingers 13 and 15 may be connected to the base 8 (e.g., end 21 may be connected to end 9 and end 23 may be connected to end 11). The first and second fingers 13 and 15 may be opposed to, spaced apart from, and springingly biased toward, one another. The second ends 22 and 24 of each of the fingers 13 and 15, respectively, may be movable against a force of the spring bias of each of the fingers 13 and 15. For example (as illustrated in FIGS. 3A-3B), a user may connect a device 20 (e.g., a plug and corresponding cable) to another device 25 (e.g., another plug and corresponding cable) and place the device 25 in between fingers 13 and 15. When inserting the device 25 in between the fingers 13 and 15, the placement pushes the ends 22 and 24 of the fingers 13 and 15, respectively, outwards to fit the device 25 therebetween. During and after insertion of the device 25, the fingers 13 and 15 operate to springingly bias toward each other to grip, hold, secure, etc. the device 25 in between the fingers 13 and 15 (e.g., in receptacle 7*b* as shown in FIGS. 2 and 3B). The base 8 and the pair of fingers 13 and 15 may be integral or releasably connected components of the second securing member 6.

The at least two substantially linearly aligned receptacles 7*a*, 7*b*, and 7*c* of the second securing member 6 may be positioned in between the first and second fingers 13 and 15 of the second securing member 6, and may be sized and shaped to receive and grip a particular shape of the at least one device 25. Each of the fingers 13 and 15 may include a portion of the at least two substantially linearly aligned receptacles 7*a*, 7*b*, and 7*c*. In at least one embodiment, the fingers 13 and 15 may each include an inner edge 17*a*, 17*b*, and 17*c* that faces the corresponding inner edge 18*a*, 18*b*, and 18*c* of the other finger. The inner edges 17*a*, 17*b*, 17*c* of the first finger 13 and the inner edges 18*a*, 18*b*, and 18*c* of the second finger 15 may define the size and shape of one or more portions of the receptacles 7*a*, 7*b*, and 7*c*. For example, the inner edges 17*a*-17*c* and 18*a*-18*c* may be sized and shaped to include at least two adjacent arch portions (as illustrated in FIGS. 1-5) that define corresponding first and second portions of the at least two substantially linearly aligned receptacles 7*a*, 7*b*, and 7*c*. The adjacent arch portions may be concave. The first and second portions (e.g., the surface area/volume defined by inner edge 17*a* and the surface area/volume defined by inner edge 18*a*, respectively, may define receptacle 7*a*; the surface area/volume defined by inner edge 17*b* and the surface area/volume defined by inner edge 18*b*, respectively, may define receptacle 7*b*; the surface area/volume defined by inner edge 17*c* and the surface area/volume defined by inner edge 18*c*, respectively, may define receptacle 7*c*; etc.) of the at least two receptacles 7*a*, 7*b*, 7*c* may be sized and shaped to receive, and to grip, at least one portion of the at least one other device 25 of the at least two devices 20 and 25. Thus, the other device 25 may be inserted, and gripped, between at least one of: the first and the second portions (e.g., inner edges 17*a* and 18*a*) of a first receptacle 7*a* of the at least two substantially linearly aligned receptacles 7*a* and 7*b*; and the first and the second portions (e.g., inner edges 17*b* and 18*b*) of a second receptacle 7*b* of the at least two substantially linearly aligned receptacles 7*a* and 7*b*. The first and second receptacles 7*a* and 7*b* may be at least one of: co-planar; spaced apart by a predetermined distance; and include a notch (e.g., notches 35*a*, 35*b*, 33*a*, 33*b* as illustrated in FIG. 3A) separating each pair of the at least two substantially linearly aligned receptacles 7*a* and 7*b*. A diameter of the at least two substantially linearly aligned receptacles may be at least: about 2 mm-about 12 mm; about 4 mm-about 10 mm; and about 7.5 mm-about 9 mm.

Figure 4A:
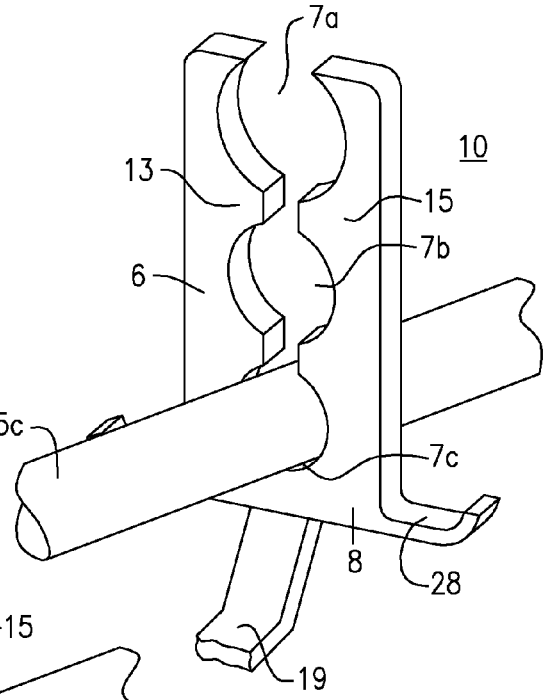
FIGS. 4*a*-4*c* are perspective views of at least one device of a predetermined size being secured in one of the receptacles of the second securing member in accordance with at least one embodiment of the present invention.
Figure 4B:
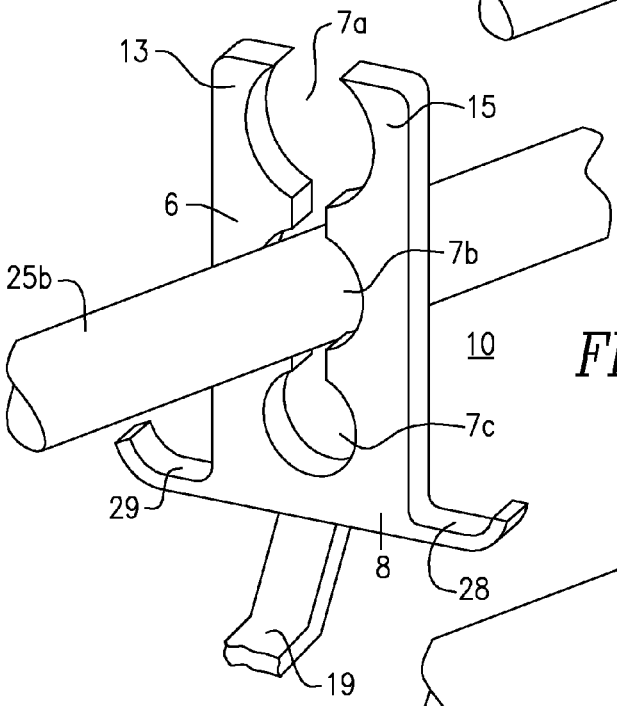
Figure 4C:
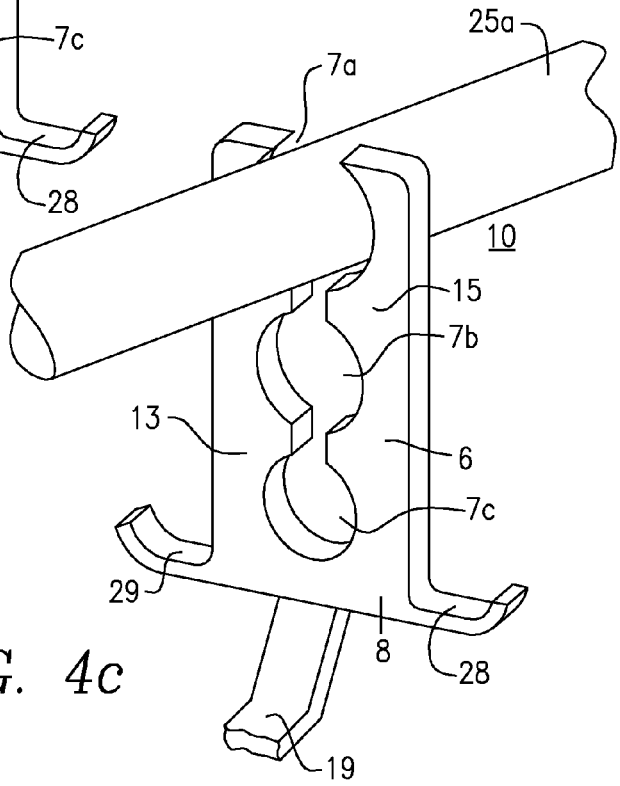

The at least two substantially linearly aligned receptacles may include a third substantially linearly aligned receptacle 7*c*. The receptacle 7*c* may include similar characteristics as those of the aforementioned receptacles 7*a* and 7*b*. The inner edges 17*c* and 18*c* of each finger 13 and 15, respectively, may define a third pair of adjacent arch portions that define corresponding first and second portions of the third receptacle 7*c*. Additionally or alternatively, the first and second portions (e.g., inner edges 17*c* and 18*c*, surface area/volume defined by inner edges 17*c* and 18*c*, etc.) of the third receptacle 7*c* may be sized, shaped, and/or located to receive, and to grip, at least one portion of the at least one other device 25 of the at least two devices 20 and 25 therebetween. The third receptacle 7*c* may be at least one of: co-planar with the first and second receptacles 7*a* and 7*b*; spaced apart from the other receptacles 7*a* and 7*b* by a predetermined distance; and include a notch (e.g., notches 35*a*, 35*b*, 33*a*, 33*b* as illustrated in FIG. 3A) separating each pair of the at least two substantially linearly aligned receptacles 7*a*, 7*b*, and 7*c*. Those skilled in the art will appreciate that the size, shape, and location of the inner edges 17*a*-17*c* and 18*a*-18*c*, and thus the corresponding first and second portions of the aligned receptacles 7*a*, 7*b*, and 7*c*, may be modified to grip devices with different sizes, shapes, and/or locations. For example, as best seen in FIGS. 4*a*-4*c*, receptacle 7*c* may be sized and shaped to receive and grip the smaller device 25*c*, receptacle 7*b* may be sized and shaped to receive a medium-sized device 25*b*, and receptacle 7*a* may be sized and shaped to receive the larger device 25*a* of the three devices 25*a*, 25*b*, and 25*c*. The devices 25*a*, 25*b*, and 25*c* may vary in size, shape, diameter, etc.

Figure 5:
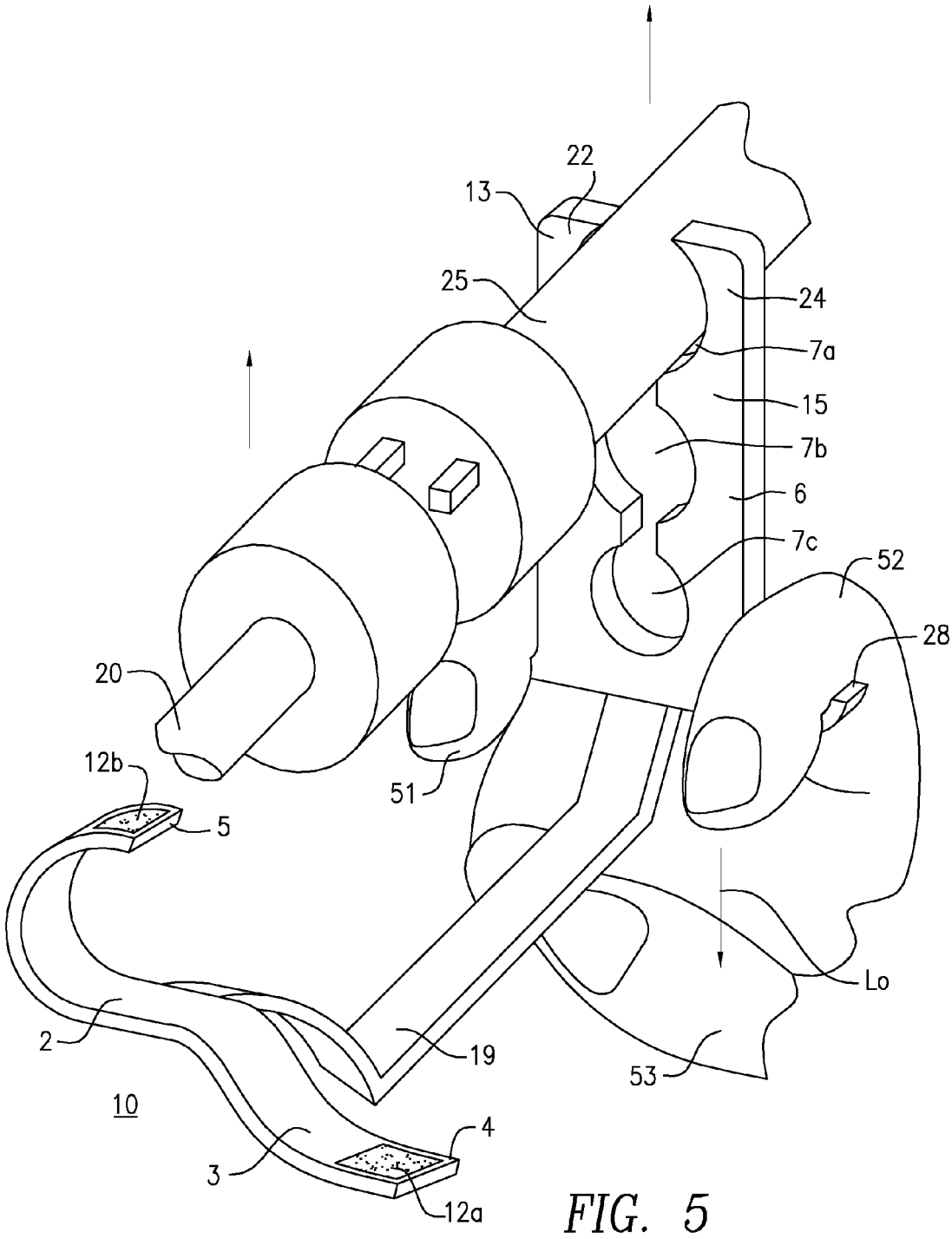
FIG. 5 is a perspective view of the apparatus of FIG. 1 illustrating the removal of the two devices therefrom in accordance with at least one embodiment of the present invention.

As illustrated in FIGS. 1-5, the base 8 may further include two levers 28 and 29, each lever 28 and 29 extending from the first and the second ends 8 and 9 of the base 8, respectively, such that the fingers 13 and 15 operate to be opened (e.g., moved away from each other, end 22 of finger 13 may be moved away from end 25 of finger 15, etc.) when the two levers 28 and 29 are both pulled away from the fingers 13 and 15 (e.g., towards the opposite side of the base 8, away from the side of the base 8 on which the fingers 13 and 15 are disposed, towards thumb 53 as illustrated in FIG. 5, in the substantial direction of axis, Lo, as illustrated in FIG. 5, etc.). The levers 28 and 29 may extend substantially away from each other (e.g., in substantially opposite directions). For example, as best seen in FIG. 5, a user may position each of fingers 51 and on the levers 28 and 29 to begin the process of inserting/removing the device 25 from one of the receptacles 7*a*, 7*b*, and 7*c* of the apparatus 10. After positioning the fingers 51 and 52, the user may squeeze the levers 28 and 29 to pull the levers 28 and 29 away from the fingers 13 and 15 (e.g., towards the opposite side of base 8, towards thumb 53 as shown in FIG. 5, etc.). The force created by the user pulls the fingers 13 and 15 away from each other such that the user may insert or remove the device 25 into one of the receptacles 7*a*, 7*b*, and 7*c* of the apparatus 10. Once the user has successfully inserted or removed the device 25, the user may stop pulling on the levers 28 and 29, thereby removing the force pulling the fingers 13 and 15 away from each other. The fingers 13 and 15 may operate to at least one of: (i) substantially return to their original configuration and/or a rest position when the two levers 28 and are released and/or substantially return to their original configuration and/or rest positions and when the at least one other device 25 of the at least two devices 20 and 25 fits within, and/or is removed from, one of the at least two substantially linearly aligned receptacles 7*a*, 7*b*, and 7*c*; and (ii) substantially grip, and clamp, the at least one other device 25 of the at least two devices 20 and 25 when the at least one other device 25 of the at least two devices 20 and 25 has a diameter that is substantially the same size or larger than a diameter of the one of the at least two substantially linearly aligned receptacles 7*a*, 7*b*, and 7*c*. In at least one embodiment, the fingers 13 and 15 may secure the device 25 even when the diameter of the device 25 is smaller than the diameter of the one of the at least two substantially linearly aligned receptacles 7*a*, 7*b*, and 7*c*. Those skilled in the art will appreciate that the structure and orientation of the levers 28 and 29 with respect to each other and to the fingers 13 and 15 may be modified in various ways while having the same effect on the fingers 13 and 15.

The connecting member 19 may include an adjustment element that operates to increase and/or decrease a length thereof such that the first securing member 2 and the second securing member 6 may be located at a predetermined position on the one device 20 and the at least one other device 25 of the at least two devices 20 and 25, respectively. The connecting member 19 may further include, but is not limited to, stretchable, flexible, elastic material, etc. The adjustment element may include, but is not limited to, an adjustable band, a cinch buckle, an adjustor, etc.

In accordance with one or more embodiments of the present invention, one or more components (e.g., the first securing member 2, the second securing member 6, the connecting member 19, etc.) of the apparatus 10 may include at least one of: colors, patterns, designs, attachments, text, textures, finishes, graphical designs, different widths, different lengths, attached embellishments, appliqués, etc. For example, a user may select an apparatus 10 with a particular design or aesthetic in order to blend in with an environment or with device(s) of the user's choice. In at least another embodiment, one or more components of the apparatus 10 may be at least one of: transparent, semi-transparent and opaque.

The first securing member 2, the second securing member 6, and the connecting member 19 of the apparatus 10 may employ less expensive, fewer, or lightweight components, such as for, but not limited to, clear plastic, polyurethane polymer, textile material, polymer, thermoplastic polyurethane polymer, cloth fabric, vinyl, leather, suede, synthetics, substantially resilient material, etc.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

The invention claimed is:

1. An apparatus for holding at least two devices together, the apparatus comprising:

a first securing member comprising an elongate member having first and second ends, the elongate member having a length between said first and second ends sufficient to wrap around one of the at least two devices, and the first end of the first securing member having securing means that operates to connect the first end to the second end;

a second securing member operating to receive at least one other of the at least two devices, the second securing member having at least two substantially linearly aligned receptacles, each receptacle operating to receive the at least one other of the at least two devices; and a connecting member coupled to, and extending from, said first securing member to said second securing member;

wherein the second securing member further comprises:

a base having first and second ends; and a pair of first and second fingers, each having first and second ends, the first and second fingers being connected to the base at the first ends thereof and extending away from the base, wherein the at least two substantially linearly aligned receptacles are located therebetween.

2. The apparatus of claim 1, wherein the base and the pair of fingers are integral.

3. The apparatus of claim 1, wherein:

the first and second fingers are opposed to, spaced apart from, and springingly biased toward, one another;

an edge of each finger facing the other finger is an inner edge; and the inner edges of the first and second fingers include at least two adjacent arch portions that define corresponding first and second portions of the at least two substantially linearly aligned receptacles.

4. The apparatus of claim 3, wherein a second end of each of the fingers is movable against a force of the spring bias of each of the fingers.

5. The apparatus of claim 4, wherein the fingers each have a respective cantilevered attachment to the base, thereby forming a spring loaded grip that operates to hold the at least one other of the at least two devices therebetween.

6. The apparatus according to claim 5, wherein:

the base includes two levers, each lever extending from the first and the second ends of the base away from each other, such that the fingers operate to be at least one of opened and moved away from each other when the two levers are both pulled away from the fingers; and the fingers operate to: (i) substantially return to at least one of their original configuration and a rest position when the two levers at least one of are released and substantially return to at least one of their original configuration and rest positions and when the at least one other of the at least two devices at least one of fits within and is removed from one of the at least two substantially linearly aligned receptacles; and (ii) substantially grip, and clamp, the at least one other of the at least two devices when the at least one other of the at least two devices has a diameter that is substantially the same size or larger than a diameter of the one of the at least two substantially linearly aligned receptacles.

7. The apparatus of claim 4, wherein the first and second portions of the at least two receptacles are sized and shaped to receive, and to grip, at least one portion of the at least one other of the at least two devices between at least one of:

the first and the second portions of a first of the at least two substantially linearly aligned receptacles; and the first and the second portions of a second of the at least two substantially linearly aligned receptacles.

8. The apparatus of claim 7, wherein the adjacent arch portions are concave.

9. The apparatus of claim 7, wherein the first and the second of the at least two substantially linearly aligned receptacles are at least one of:

co-planar;

spaced apart by a predetermined distance; and include a notch separating each pair of the at least two substantially linearly aligned receptacles.

10. The apparatus of claim 7, wherein the at least one portion of the at least one other of the at least two devices has substantially the same or a larger diameter than a diameter of the receptacle, when in a rest position, in which it is held.

11. The apparatus of claim 7, wherein the inner edge of each finger includes at least three adjacent arch portions that define corresponding first and second portions of at least three substantially linearly aligned receptacles.

12. The apparatus of claim 11, wherein the first and second portions of the at least three receptacles are sized and shaped to receive, and to grip, at least one portion of the at least one other of the at least two devices between at least one of:

the first and the second portions of a first of the at least two substantially linearly aligned receptacles;

the first and the second portions of a second of the at least two substantially linearly aligned receptacles; and the first and the second portions of a third of the at least two substantially linearly aligned receptacles.

13. The apparatus of claim 12, wherein the adjacent arch portions are concave.

14. The apparatus of claim 12, wherein the first, the second, and the third of the at least two substantially linearly aligned receptacles are at least one of:

co-planar;

spaced apart by a predetermined distance; and include a notch separating each pair of the at least two substantially linearly aligned receptacles.

15. The apparatus of claim 12, wherein the at least one portion of the at least one other of the at least two devices has substantially the same or a larger diameter than a diameter of the receptacle, when in a rest position, in which it is held.

16. The apparatus of claim 1, wherein the securing means operates to releasably close the first securing member around an outer surface of the one of the at least two devices.

17. The apparatus of claim 1, wherein the connecting member comprises at least one of:

an adjustment element that operates to at least one of increase and decrease a length thereof such that the first securing member and the second securing member can be located at a predetermined position on the one and the at least one other of the at least two devices, respectively; and at least one of stretchable material, flexible material, and elastic material.

18. The apparatus of claim 1, wherein at least one of:

at least one of the first securing member, the second securing member, and the connecting member of the apparatus are at least one of: transparent, semi-transparent and opaque; and at least one of the first securing member, the second securing member, and the connecting member comprise at least one of: clear plastic, polyurethane polymer, textile material, polymer, thermoplastic polyurethane polymer, cloth fabric, vinyl, leather, suede, synthetics, and substantially resilient material.

19. The apparatus of claim 1, wherein a diameter of the at least two substantially linearly aligned receptacles is at least: about 2 mm-about 12 mm; about 4 mm-about 10 mm; and about 7.5 mm-about 9 mm.

* * * * *